US007278823B2

(12) United States Patent
Platz

(10) Patent No.: US 7,278,823 B2
(45) Date of Patent: Oct. 9, 2007

(54) DRAFT INDUCER BLOWER

(75) Inventor: John A Platz, Springfield, MO (US)

(73) Assignee: Fasco Industries, Inc., Eaton Rapids, MI (US)

( * ) Notice: Subject to any disclaimer, the term of this patent is extended or adjusted under 35 U.S.C. 154(b) by 104 days.

(21) Appl. No.: 10/934,004

(22) Filed: Sep. 3, 2004

(65) Prior Publication Data

US 2006/0051205 A1 Mar. 9, 2006

(51) Int. Cl.
*F04D 29/42* (2006.01)

(52) U.S. Cl. ..... 415/204; 415/206; 415/212.1

(58) Field of Classification Search ..... 415/206, 415/204, 207, 212.1, 224, 224.5
See application file for complete search history.

(56) References Cited

U.S. PATENT DOCUMENTS

| | | | | |
|---|---|---|---|---|
| 1,484,055 | A | | 2/1924 | Beugler |
| 1,650,873 | A | | 11/1927 | Kay |
| 2,411,816 | A | | 11/1946 | Teague, Jr. |
| 2,540,178 | A | | 2/1951 | Smith |
| 3,145,912 | A | | 8/1964 | Weis |
| 3,300,122 | A | | 1/1967 | Bowles et al. |
| 3,856,431 | A | | 12/1974 | Tucker ..... 415/219 |
| 4,599,042 | A | | 7/1986 | Colliver ..... 415/204 |
| 5,257,904 | A | | 11/1993 | Sullivan ..... 415/214.1 |
| 5,281,092 | A | * | 1/1994 | Sullivan ..... 415/206 |
| 5,316,439 | A | | 5/1994 | Gatley, Jr. et al. ..... 415/119 |
| 5,443,364 | A | | 8/1995 | Mistry et al. ..... 415/214.1 |
| 5,484,259 | A | | 1/1996 | Ahmed et al. ..... 415/119 |
| 5,536,140 | A | | 7/1996 | Wagner et al. |
| 5,569,017 | A | * | 10/1996 | Barnhart et al. ..... 415/206 |
| 5,620,302 | A | | 4/1997 | Garrison et al. ..... 415/169.2 |
| 5,954,476 | A | | 9/1999 | Stewart et al. ..... 415/214.1 |

(Continued)

FOREIGN PATENT DOCUMENTS

| | | |
|---|---|---|
| JP | 54-21608 | 2/1979 |

(Continued)

*Primary Examiner*—Richard A Edgar
(74) *Attorney, Agent, or Firm*—Baker & Daniels LLP

(57) ABSTRACT

A draft inducer blower for high efficiency furnaces, including a blower housing which facilitates maximum air flow efficiency through the blower housing while having an overall radial dimension which conforms to the industry standard arrangement of mounting holes on the walls of the furnaces. The blower housing generally includes a housing body and housing cover, the housing body including a plurality of mounting lugs spaced around the housing body through which bolts may be inserted to secure the blower housing to the mounting holes in the wall of a furnace. The housing cover and housing body each define portions of a volute which extends around the outer periphery of the blower housing from the cutoff region to the exhaust transition of the blower housing. The volute includes a cross-sectional area which substantially continuously increases in the axial direction of the blower housing from the cutoff region to the exhaust transition. In this manner, the blower housing has a radial dimension which conforms to the industry standard mounting hole arrangements for furnaces, yet includes a volute having an increasing cross-sectional area around the blower housing to provide a diffuser section within the blower housing to maximize air flow efficiency. The housing cover is positioned close to the impeller periphery to prevent recirculation. The housing cover is provided with a conical section and ribbing to minimize assembly-caused inlet deflection and to optimize air flow.

16 Claims, 14 Drawing Sheets

U.S. PATENT DOCUMENTS

| | | | | |
|---|---|---|---|---|
| D439,648 | S * | 3/2001 | Jones et al. | D23/370 |
| 6,206,633 | B1 | 3/2001 | Nakamura et al. | |
| 6,314,894 | B1 | 11/2001 | Gatley, Jr. | 110/341 |
| 6,386,123 | B1 | 5/2002 | Gatley, Jr. | 110/205 |
| 6,468,034 | B1 | 10/2002 | Garrison et al. | |
| 6,494,152 | B2 | 12/2002 | Gatley, Jr. | 110/341 |
| 6,511,288 | B1 * | 1/2003 | Gatley, Jr. | 415/206 |
| 6,553,923 | B2 | 4/2003 | Gatley, Jr. | 110/162 |
| 6,595,146 | B2 | 7/2003 | Gatley, Jr. | 110/162 |
| 6,604,906 | B2 | 8/2003 | Ozeki et al. | 415/204 |
| 2002/0138941 | A1 | 10/2002 | Paterson et al. | |

FOREIGN PATENT DOCUMENTS

| | | | |
|---|---|---|---|
| JP | 54021608 A | * | 2/1979 |

* cited by examiner

DRAFT INDUCER BLOWER

BACKGROUND OF THE INVENTION

1. Field of the Invention

The present invention relates to air moving devices, and in particular, to blowers of the type which are used with high efficiency (e.g., 90% or higher efficiency) furnaces for drawing air from outside of a building into the furnace to support combustion and to expel combustion exhaust products outside of the building. More particularly, the present invention relates to a blower which provides increased air flow through the blower and decreased blower noise while maintaining an overall diameter for the housing of the blower which conforms to, and is compatible with, industry standard mounting bolt patterns on furnaces for attachment of blower housings.

2. Description of the Related Art

In high efficiency furnaces, standard chimney air-draw effects are not sufficient to assure the required air flow through the furnace heat exchangers, and therefore, high efficiency furnaces utilize draft inducer blowers to provide sufficient air flow through the furnace. In particular, the blowers of high efficiency furnaces pull flue gases through the furnace heat exchangers and then push the flue gases out through exhaust piping to the exterior of the building. The length of the flue piping is limited by the static pressure induced on the flue gases by the draft inducer blower, and higher static pressures typically allow longer runs of flue piping. One measure of the efficiency of the draft inducer blower is the static pressure generated by the blower on the flue gases at a given air flow rate, wherein a blower is more efficient if it can generate higher pressures and air flows for a given power input to the electric motor which drives the blower impeller.

Centrifugal blowers generate pressure by doing work on the air flow through the blower housing by rotating the impeller of the blower. The angular momentum of the impeller produces a velocity pressure within the blower housing that must be converted to a static pressure by diffusion. In blowers where the diffuser section is wrapped around the periphery of the impeller, the diffuser may take the form of a scroll or volute which increases in the radial direction with respect to the rotational axis of the impeller. Forward-bladed impellers common in known furnace blowers require a volute diffuser section to convert velocity pressure into static pressure. Ideally, if the diffuser section grows at the same rate as the airflow being radially pumped into the diffuser section from the impeller, the airflow through all of the impeller blade passages will be uniform, and the airflow around the volute diffuser section will have uniform average velocity.

For example, in one known expanding scroll-type diffuser blower disclosed in U.S. Pat. No. 4,599,042 to Colliver, the axial end walls of the blower housing are parallel to one another, and the outer or side wall of the blower housing is scrolled radially outwardly such that the radial distance between the axis of the impeller and the side wall progressively increases at a constant rate around the blower circumference from the cutoff region of the blower housing toward the outlet of the blower housing.

However, in draft inducer blowers for high efficiency furnaces, the standard bolt pattern in the wall of the furnace to which the blower housing is attached, imposes a limitation to the diameter and overall size of the blower housing in the radial dimension. Also, due to the potential for corrosion of the attachment bolts by the exhaust flue gases, the side wall of the blower housing is usually positioned between the attachment bolts and the interior of the blower housing. For these reasons, the effective air volume of the blower is generally restrained in the radial dimension by the standard bolt pattern of existing furnaces.

One known blower for a high efficiency furnace is shown in FIGS. 1-4, and generally includes a blower housing 20 having a housing body 22 and a housing cover 24. Housing body 22 is formed as a molded plastic component, having a cylindrical outer wall 26, a planar top wall 28, and an axially recessed, planar wall 30 to which electric motor 32 is mounted. Housing body 22 further includes an integral, tubular exhaust transition 34 and outlet projecting tangentially therefrom, to which an exhaust pipe (not shown) is connected. Housing cover 24 is a substantially flat, molded plastic circular plate which is attached to housing body 22 by being captured between housing body 22 and wall 36 of a furnace, as shown in FIG. 4. Specifically, after blower housing 20 is positioned near the furnace wall 36 as shown in the left side of FIG. 4, a plurality of bolts 38 are inserted through respective mounting lugs 40 in housing body 22 and into a set of corresponding holes 42 in furnace wall 36 to thereby attach the blower housing 20 to the furnace, as shown in the right side of FIG. 4. Holes 42 in furnace wall 36 are disposed in a standard pattern with a predetermined, fixed diameter.

An impeller 44, shown in FIGS. 2-4, is disposed within the interior of blower housing 20 between housing body 22 and housing cover 24, and is mounted for rotation upon drive shaft 46 of motor 32. In operation, rotation of impeller 44 by motor 32 draws exhaust gases through a centrally disposed circular inlet 48 in housing cover 24 from the furnace into the blower housing 20, and the exhaust gases are discharged through the outlet of exhaust transition 34. Although the foregoing blower housing has proven to be effective for use with high efficiency furnaces, improvements to same are desired.

In blower housing 20, the diameter of outer wall 26 and the corresponding radial dimension of blower housing 20 is limited by the standard bolt pattern of the furnace. Therefore, forming outer wall 26 to create a radially-expanding diffuser section, in which the distance between the axis of impeller 44 and outer wall 26 constantly increases in the radial direction around the circumference of blower housing from cutoff 50 (FIG. 2) toward exhaust transition 34, is not practicable for converting the velocity pressure of the air flow into static pressure. Thus, because the size of blower housing 20 is effectively fixed in the radial direction, other means of diffusing the velocity pressure of the air flow must be utilized. A further, related design consideration is the desirability to maximize the diameter and overall size of the impeller used with the blower housing.

As described below, the cylindrical outer wall 26 of blower housing 20 effectively sets up a diffusion section within the air flow so that blower housing 20 can accommodate the radial air flow from impeller 44. Referring to FIG. 2, air flow within blower housing is shown by the several arrows. The cylindrical outer wall 26 of blower housing 20 causes the air flow to have a high pressure and very low or no velocity flow from cutoff 50 of blower housing 20 to about a third of the way around the circumference of outer wall 26. As shown by the air flow arrows in FIG. 2, some air flow may actually go backwards from this high pressure region toward cutoff 50 and exhaust transition 34. Air flow tends to stagnate in the blade passages of impeller 44 as the impeller blades pass this high pressure area. About a third of the way around the circumference of outer wall 26 from cutoff 50, the air starts to move and then accelerate around the remainder of the circumference of blower housing 20 towards the outlet of exhaust transition 34. Thus, as shown by the air flow arrows in FIG. 2, the air flow through the blade passages of impeller 44 only exits the blade passages in about two-thirds of the blade passages of impeller 44 at any given time and, as impeller 44 rotates, the air flow in the blade passages thereof is inefficiently surging to full flow and then back to a stop during every revolution of impeller 44. In this manner, blower housing 20 sets up its own "diffuser" section by creating asymmetric, cyclic flow through the blade passages of impeller 44, which is not optimally efficient.

A further disadvantage with known blower housings for high efficiency furnaces is the presence of a rather large gap between housing cover 24 and the bottom of impeller 44, shown as distance $D_1$ in FIGS. 3 and 4, which is typically approximately 0.257 inches. This gap is necessary to allow for some inward deflection of housing cover 24, as shown in the right side of FIG. 4, when blower housing 20 is attached to wall 36 of a furnace, in which the inlet 48 of housing cover 24 may be deflected upwardly toward impeller 44 by contact with gasket 52 between housing cover 24 and furnace wall 36. Typically, distance $D_1$ is reduced to 0.247 inches or less after such deflection. The relatively large gap between housing cover 24 and impeller 44 could potentially allow some recirculation of the air flow within blower housing 20, in which air leaks back between impeller 44 and housing cover 24 toward inlet 48 of blower housing 20 instead of exiting through the outlet of exhaust transition 34, which could potentially lessen the performance and efficiency of the blower. Additionally, a large degree of deflection of the inlet 48 of housing cover 24 toward impeller 44 could potentially inhibit airflow through inlet 48 to the central inlet portion of impeller 44. Specifically, as shown in FIG. 4, distance $D_2$ between housing cover 24 and impeller 44 near inlet 48 reduces from approximately 0.297 inches, as shown in the left side of FIG. 4, to approximately 0.120 inches, as shown in the right side of FIG. 4, by inward deflection of housing cover 24.

What is needed is a draft inducer blower housing for high efficiency furnaces which is an improvement on the foregoing.

SUMMARY OF THE INVENTION

The present invention provides a draft inducer blower for high efficiency furnaces, including a blower housing which facilitates maximum air flow efficiency through the blower housing while having an overall radial dimension which conforms to the industry standard arrangement of mounting holes on the walls of the furnaces. The blower housing generally includes a housing body and housing cover, the housing body including a plurality of mounting lugs, spaced around the outer periphery of the housing body, through which bolts may be inserted to secure the blower housing to the mounting holes in the wall of a furnace. The housing cover and housing body each define portions of a volute which extends around the outer periphery of the blower housing from the cutoff to the exhaust transition of the blower housing. The volute includes a cross-sectional area which substantially continuously increases in the axial direction of the blower housing from the cutoff region to the exhaust transition. In this manner, the blower housing has a radial dimension which conforms to the industry standard mounting hole arrangements for furnaces, yet includes a volute having an increasing cross-sectional area around the blower housing to provide a diffuser section within the blower housing to maximize air flow efficiency.

More specifically, the housing body defines a portion of the volute between the outer wall, top wall, and inner wall of the housing body which increases in height in the axial or Z-axis direction from the cutoff to the exhaust transition of the blower housing. Additionally, the housing cover includes an annular depression which increases in depth in the axial or Z-axis direction from the cutoff region to the exhaust transition. In this manner, both the housing body and housing cover cooperate to define portions of the volute and to contribute to the total expanding cross sectional area of the volute from the cutoff to the exhaust transition.

Additionally, the housing cover includes an annular ridge which projects upwardly toward the lower plate of the impeller within the blower housing to define a small clearance distance therebetween, which reduces or eliminates the passage of air from the volute between the impeller and the housing cover toward the inlet of the blower housing to substantially seal the air flow within the volute. The housing cover also includes a plurality of radial stiffening ribs which minimize or eliminate inward deflection of the inlet portion of the housing cover when the blower housing is attached to the wall of a furnace, to reduce or eliminate choking of the inlet air as same flows through the inlet opening of the housing cover into the impeller. Further, the housing cover includes a conically-shaped, sloped wall which provides a clearance space between the inlet portion of the housing cover and the impeller to accommodate any minor inward deflection of the inlet portion of the housing cover when the blower housing is attached to the furnace.

In one form thereof, the present invention provides a blower housing having an outer periphery and defining perpendicular radial and axial directions, the blower housing including first and second housing members defining a cavity therebetween; a plurality of mounting lugs disposed in spaced relation around the outer periphery of the blower housing; an inlet and an outlet, each defined within at least one of the first and second housing members; a cutoff within the blower housing, the cutoff disposed proximate the outlet; and a volute defined within at least one of the first and second housing members, the volute curved around the outer periphery of the blower housing through an angle of at least 180° and having a cross-sectional area which substantially continuously increases toward the outlet.

In another form thereof, the present invention provides a blower housing defining perpendicular radial and axial directions, the blower housing including first and second housing members defining a cavity therebetween; a plurality of mounting lugs including apertures, the mounting lugs disposed in spaced relation around the blower housing; an inlet defined within at least one of the first and second housing members; an outlet defined within at least one of the first and second housing members, the outlet facing in the radial direction; a cutoff within the blower housing proximate the outlet; and a volute defined within at least one of the first and second housing members, the volute curved through an angle of at least 180° and having a height in the axial direction which substantially continuously increases toward the outlet.

In a further form thereof, the present invention provides a blower assembly, including a blower housing having a substantially circular outer periphery defining perpendicular axial and radial directions, the blower housing including a first housing member attached to a second housing member, the first and second housing members together defining a cavity therebetween; a plurality of mounting lugs formed as a portion of at least one of the first and second housing members, the mounting lugs disposed in spaced relation around the outer periphery; an inlet opening in the second housing member; a outlet opening defined by at least one of the first and second housing members; a cutoff disposed proximate the outlet; and a volute formed as a portion of at least one of the first and second housing members, the volute curved around the outer periphery through an angle of at least 180° from a first end thereof proximate the cutoff to a second end thereof proximate the outlet, the volute section having a cross-sectional area which substantially continuously increases from the first end toward the second end; a motor mounted to one of the first and second housing members, the motor having a rotatable shaft extending into the cavity; and an impeller coupled to the shaft for rotation therewith, the impeller disposed within the cavity.

In a still further form thereof, the present invention provides a blower housing, including a first housing member; a second housing member attached to the first housing member to define a cavity therebetween, the second housing member further including an inlet opening; an annular ridge around the inlet opening, the annular ridge projecting into the cavity toward the second housing member; and an annular wall extending from the ridge to the inlet opening, the wall sloped from the ridge to the inlet opening in a direction away from the first housing member.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION

Figure 1:
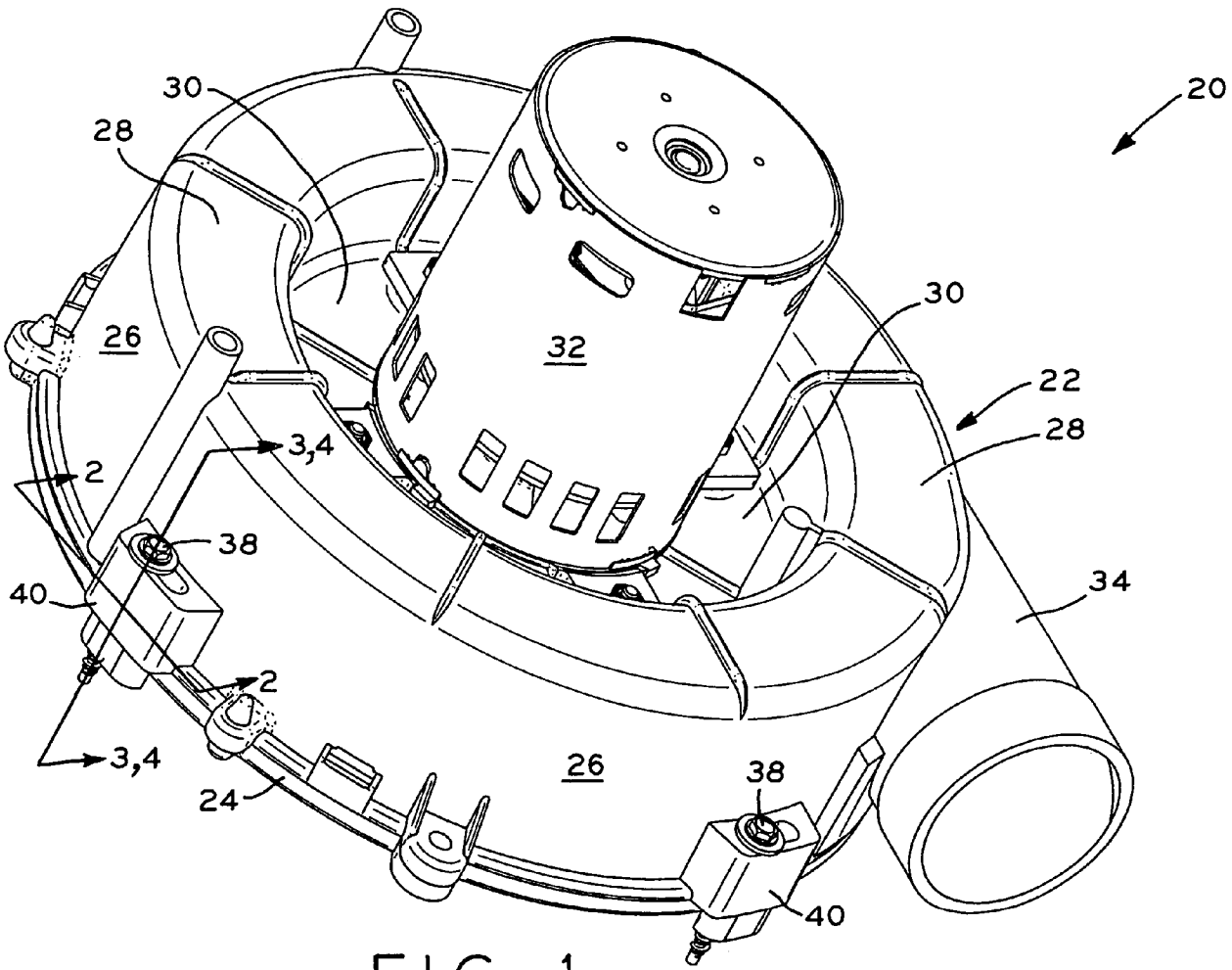
FIG. 1 PRIOR ART
FIG. 1 is a perspective view of a known blower for high efficiency furnaces.
Figure 2:
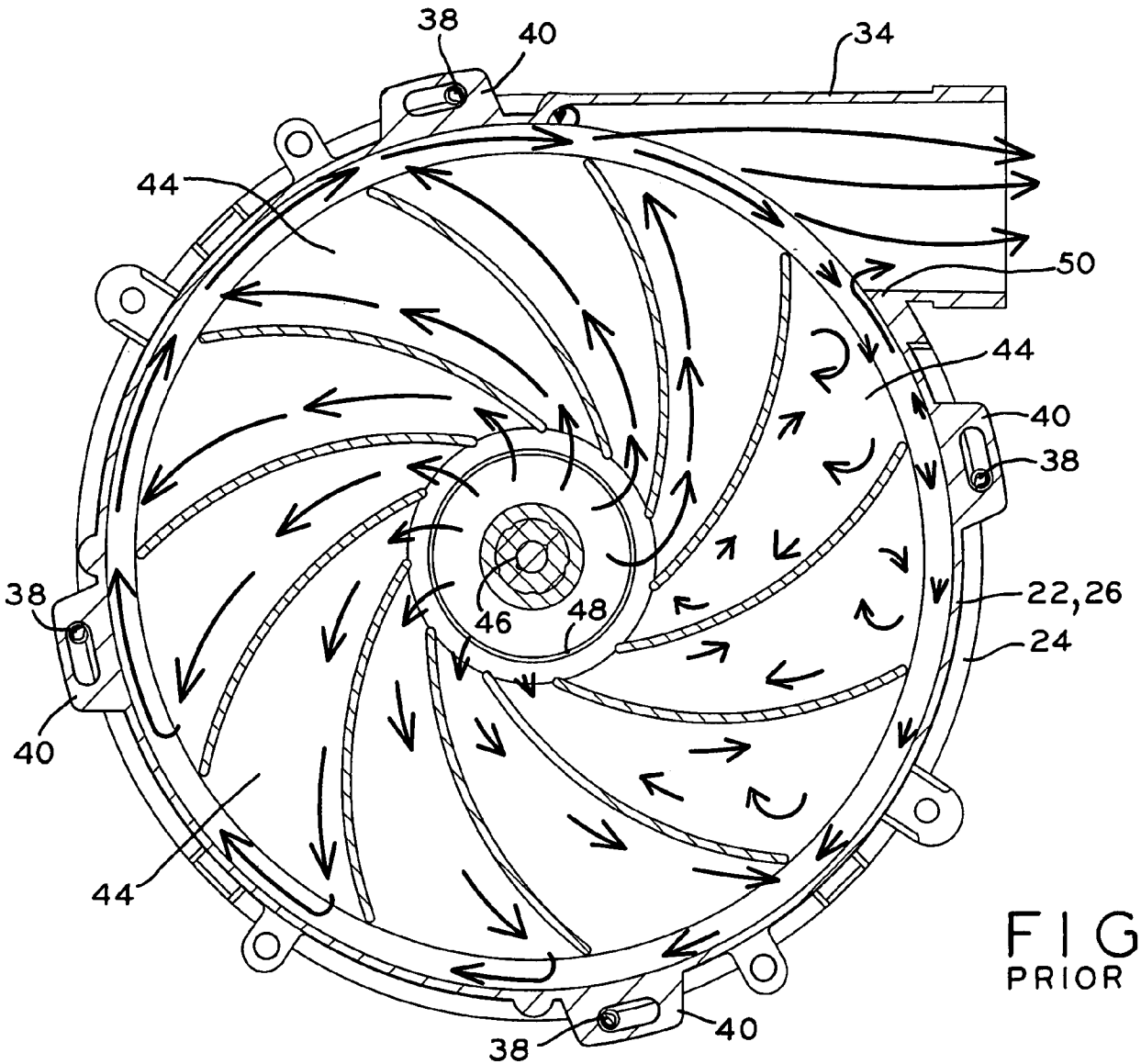
FIG. 2 PRIOR ART
FIG. 2 is a horizontal sectional view through the blower of FIG. 1, taken along line 2-2 of FIG. 1 and looking downwardly, with the air flow through the blower housing shown by arrows.
Figure 3:
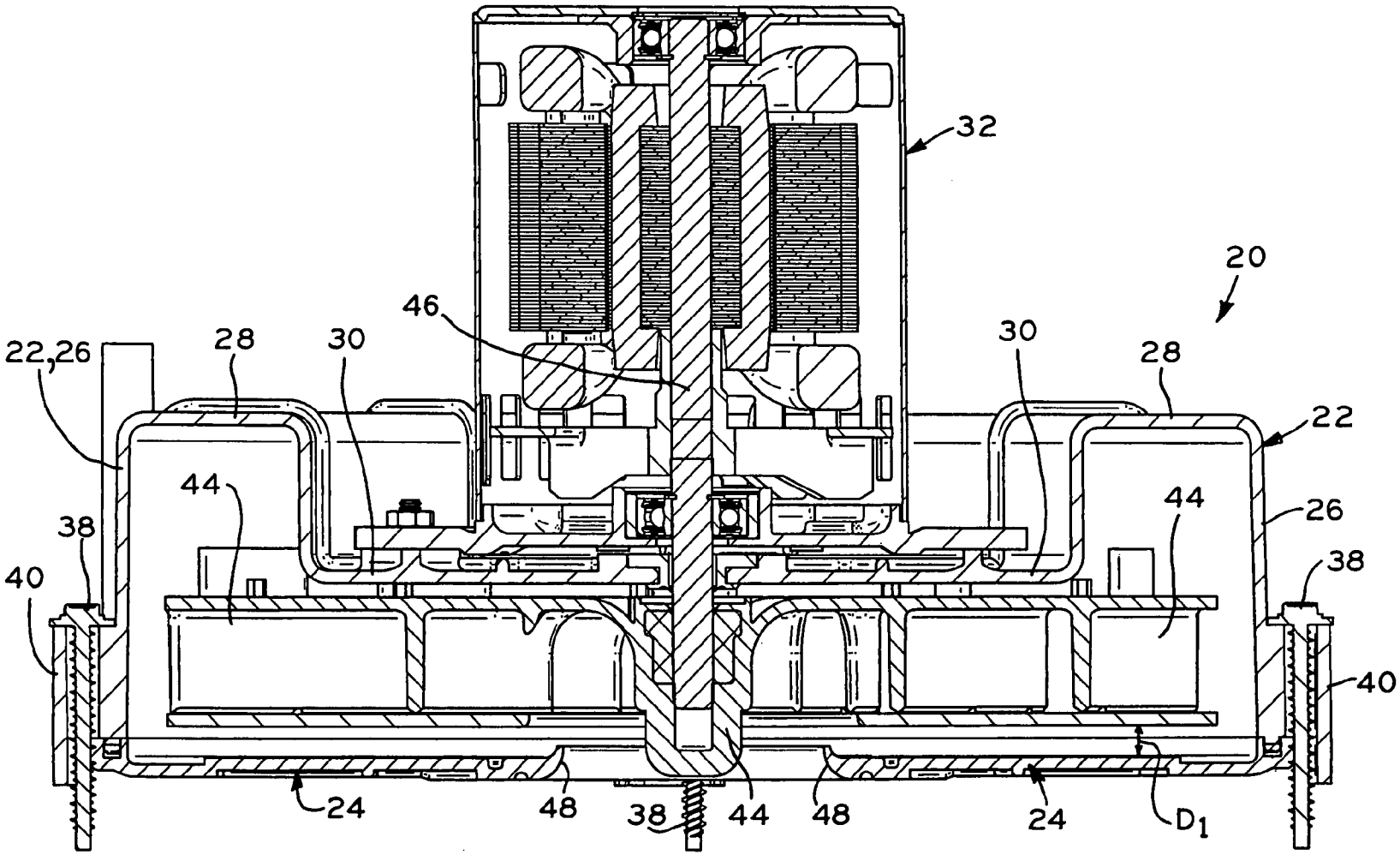
FIG. 3 PRIOR ART
FIG. 3 is a first vertical sectional view through the blower of FIG. 1, taken along line 3-3 of FIG. 1.
Figure 4:
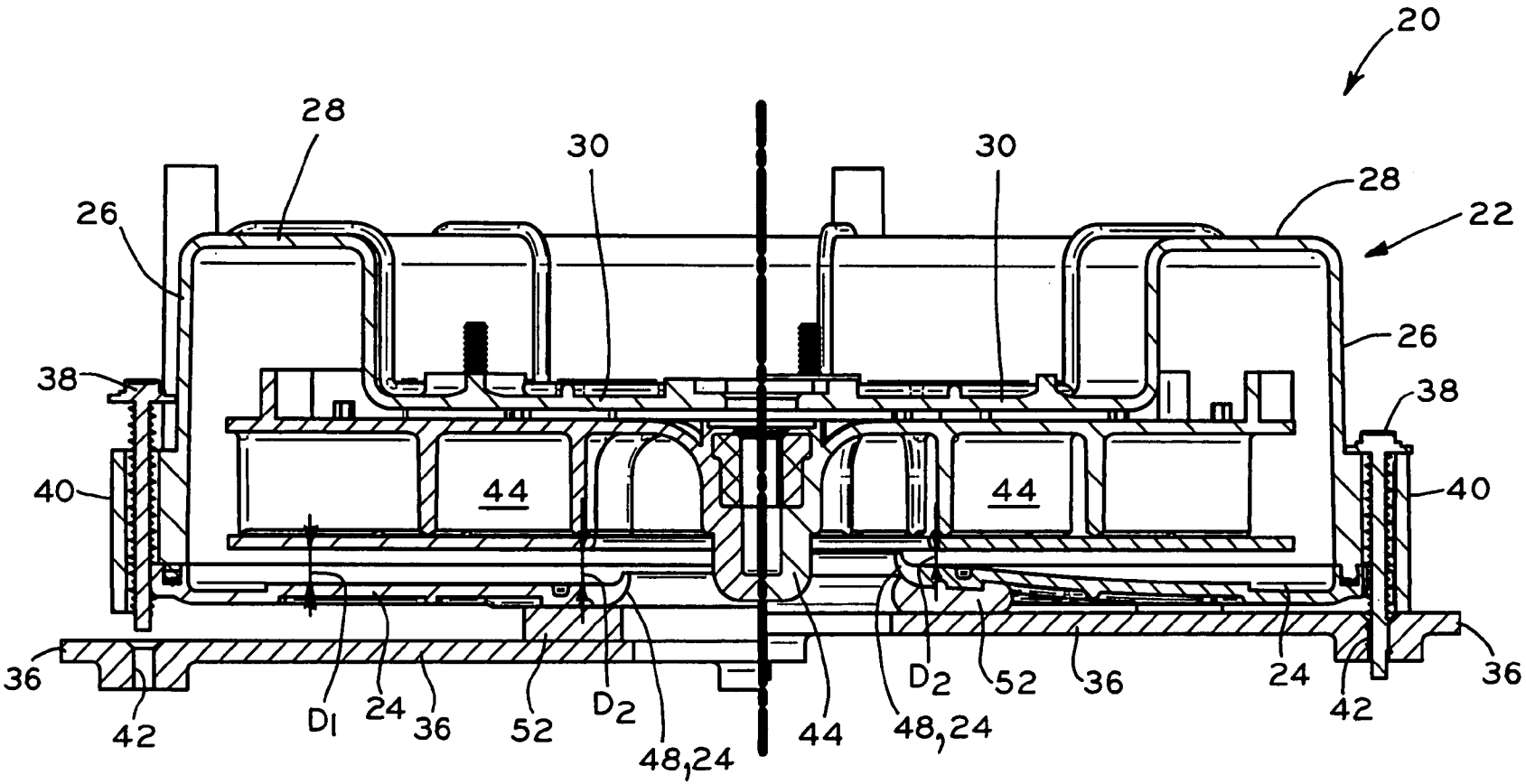
FIG. 4 PRIOR ART
FIG. 4 is a second vertical sectional view through the blower housing and impeller of the blower of FIG. 1, taken along line 4-4 of FIG. 1, showing the blower housing positioned near a furnace wall on the left side of FIG. 4, and showing the blower housing attached to the furnace wall on the right side of FIG. 4.
Figure 5:
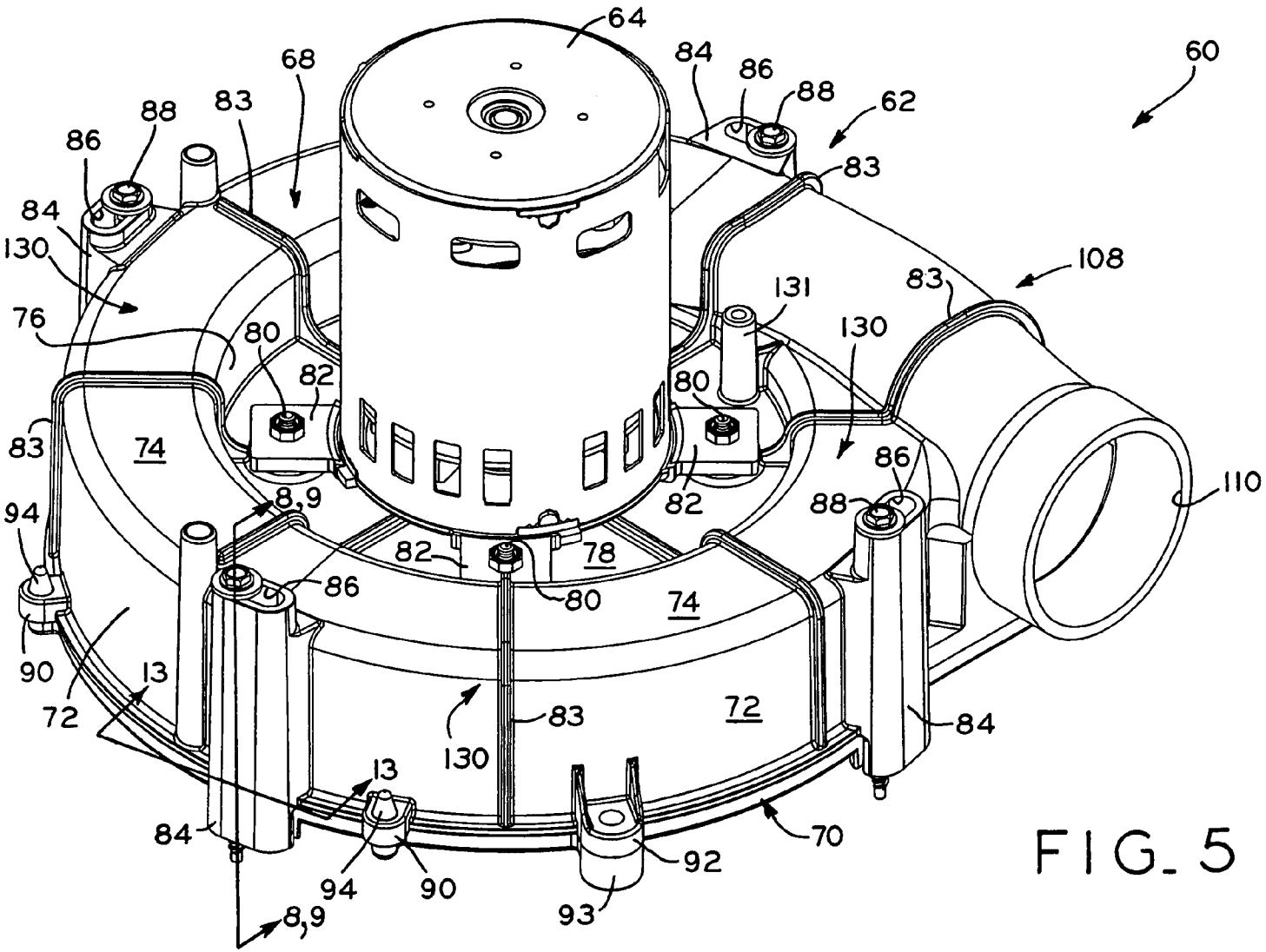
FIG. 5 is a perspective view of a blower for high efficiency furnaces, including a blower housing according to the present invention.

Referring first to FIG. 5, a blower 60 for a high efficiency furnace according to the present invention is shown. Blower 60 generally includes blower housing 62, electric motor 64 mounted to blower housing 62, and an impeller (FIGS. 6-9), mounted to the output shaft of motor 64 and disposed within blower housing 62. Blower housing 62 generally includes a first housing member or housing body 68, and a second housing member or housing cover 70. Housing body 68 and housing cover 70 may be formed of metal or plastic according to an injection molding process, for example. Suitable plastics for housing body 68 and housing cover 70 include polypropylene or other thermoplastics. Housing body 68 includes a generally cylindrical outer wall 72, an annular top wall 74, an inner wall 76, and a recessed wall 78. Motor 64 is attached to recessed wall 78 by a plurality of fasteners 80 which pass through mounting flanges 82 of motor 64 into recessed wall 78 of housing cover 70. Housing cover 70 additionally includes a plurality of reinforcement ridges 83 extending along outer wall 72, top wall 74, inner wall 76, and recessed wall 78 for providing structural strength and rigidity to housing cover 70. Generally, blower housing 62 defines an axial or Z-axis direction which is aligned along the axis of output shaft 66 of motor 64 and the rotational axis of impeller, as well as radial or X- and Y-axis directions which are aligned perpendicular to the axial or Z-axis direction.

Figure 9:
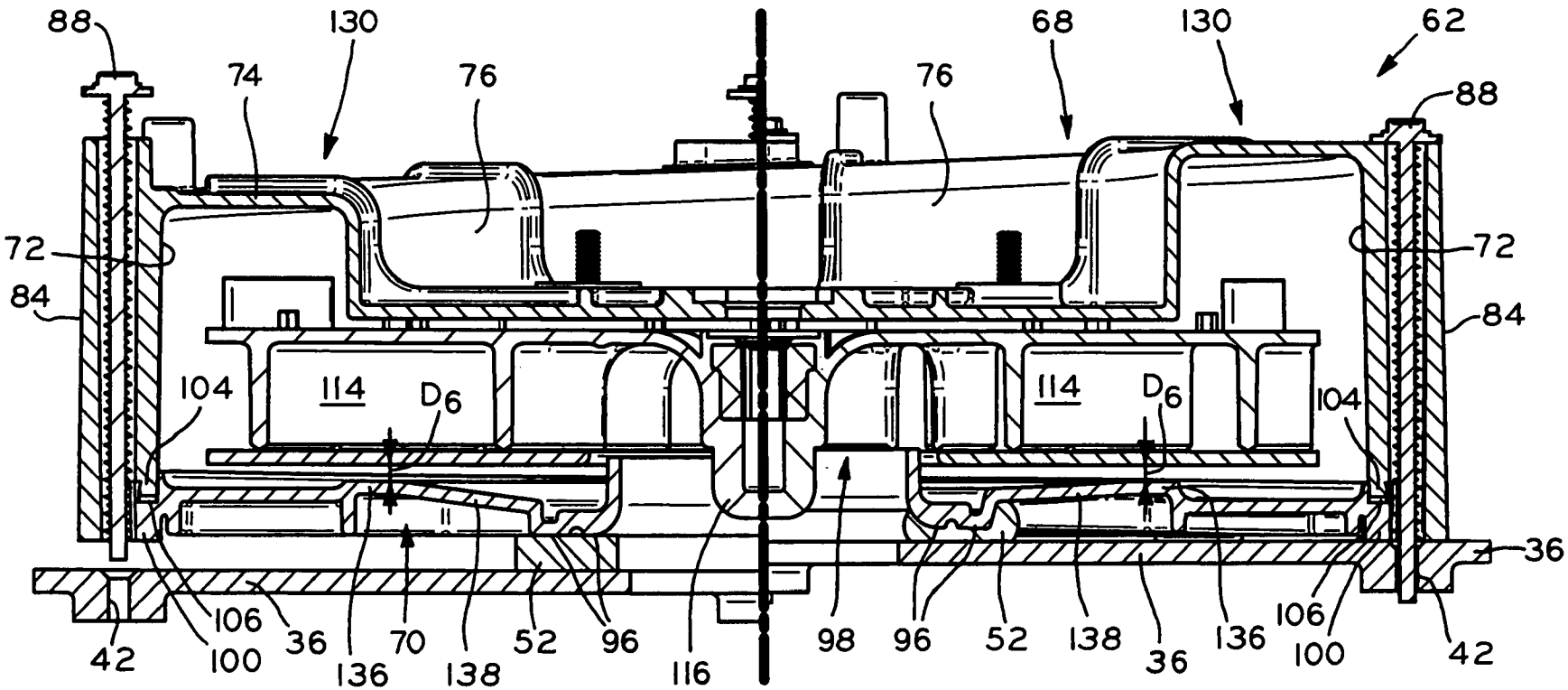
FIG. 9 is a second vertical sectional view through the blower housing and impeller of the blower of FIG. 5, taken along line 9-9 of FIG. 5, showing the blower housing positioned near a furnace wall on the left side of FIG. 9, and showing the blower housing attached to the furnace wall on the right side of FIG. 9.

Housing body 68 additionally includes a plurality of mounting lugs 84 integrally formed therewith, which are disposed radially outwardly of sidewall 72 and spaced around the outer periphery of blower housing 62. Alternatively, at least a portion of mounting lugs 84 may be formed with housing cover 70. Mounting lugs 84 include slot-like or oval openings 86 for receipt of bolts 88 to attach blower housing 62 to wall 36 of a furnace. As shown in FIG. 9, bolts 88 extend downwardly through mounting lugs 84 of housing body 68, adjacent recesses 102 in lug feet 100 of housing cover 70 (discussed below), and into holes 42 in furnace wall 36 to rigidly secure blower housing 62 to wall 36 of the furnace, with housing cover 70 captured between housing body 68 and furnace wall 36. Additionally, housing body 68 includes a plurality of locating lugs 90 integrally formed therewith, which are disposed radially outwardly of outer wall 72 and spaced around the periphery of housing cover 70. Locating lugs 90 include openings for receipt of upwardly-projecting locating pins 94 of housing cover 70 to thereby positively locate housing cover 70 with respect to housing body 68 during assembly of blower housing 62. Optionally, housing body 68 includes one or more attachment lugs 92 for receipt of fasteners (not shown) which pass therethrough and also through one or more corresponding optional attachment lugs 93 of housing cover 70 to secure blower housing 22 to furnaces having an alternate furnace mounting bolt pattern. Further details of housing body 68 are discussed below.

Figure 6:
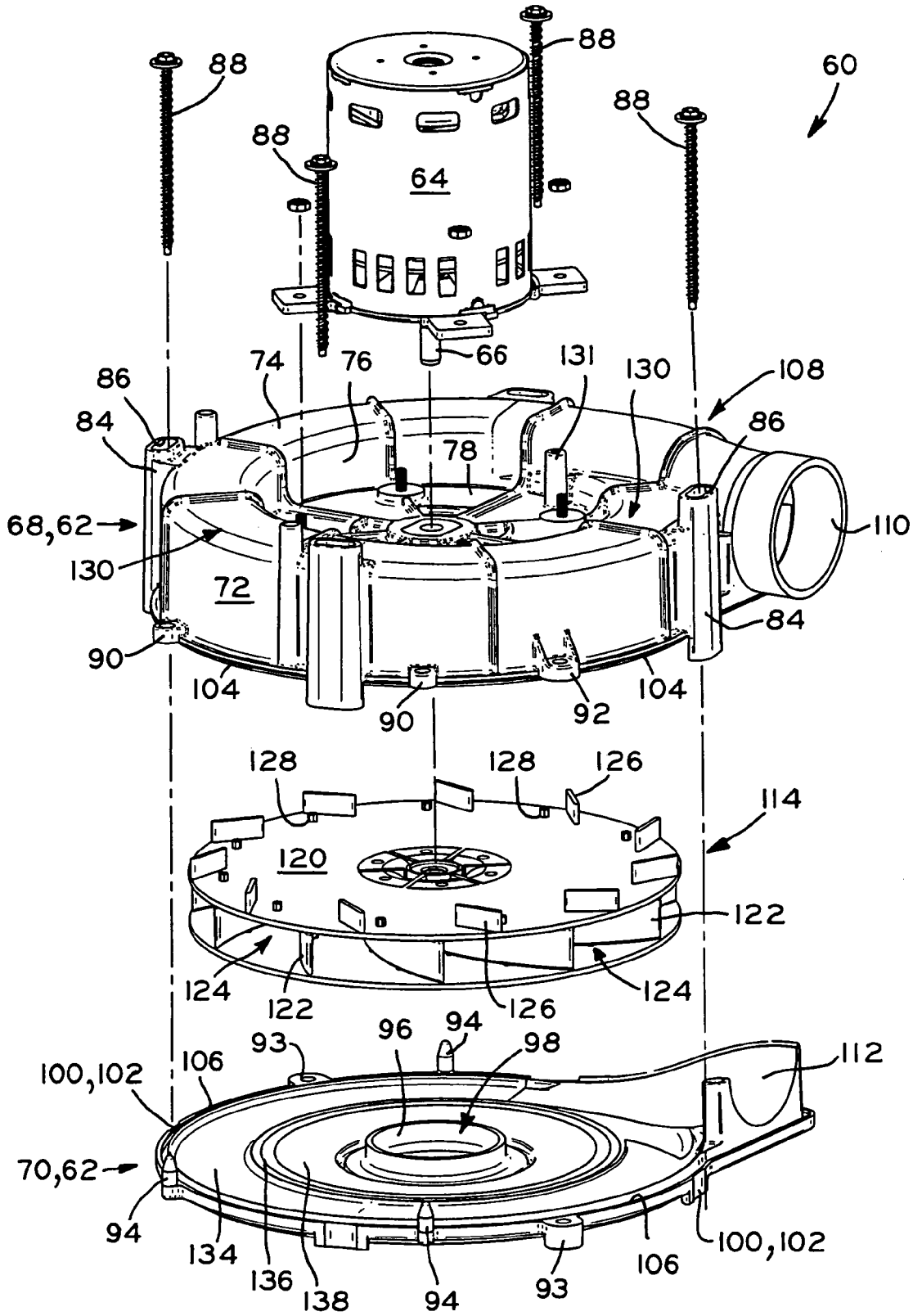
FIG. 6 is a first exploded view of the blower of FIG. 5, looking downwardly.
Figure 7:
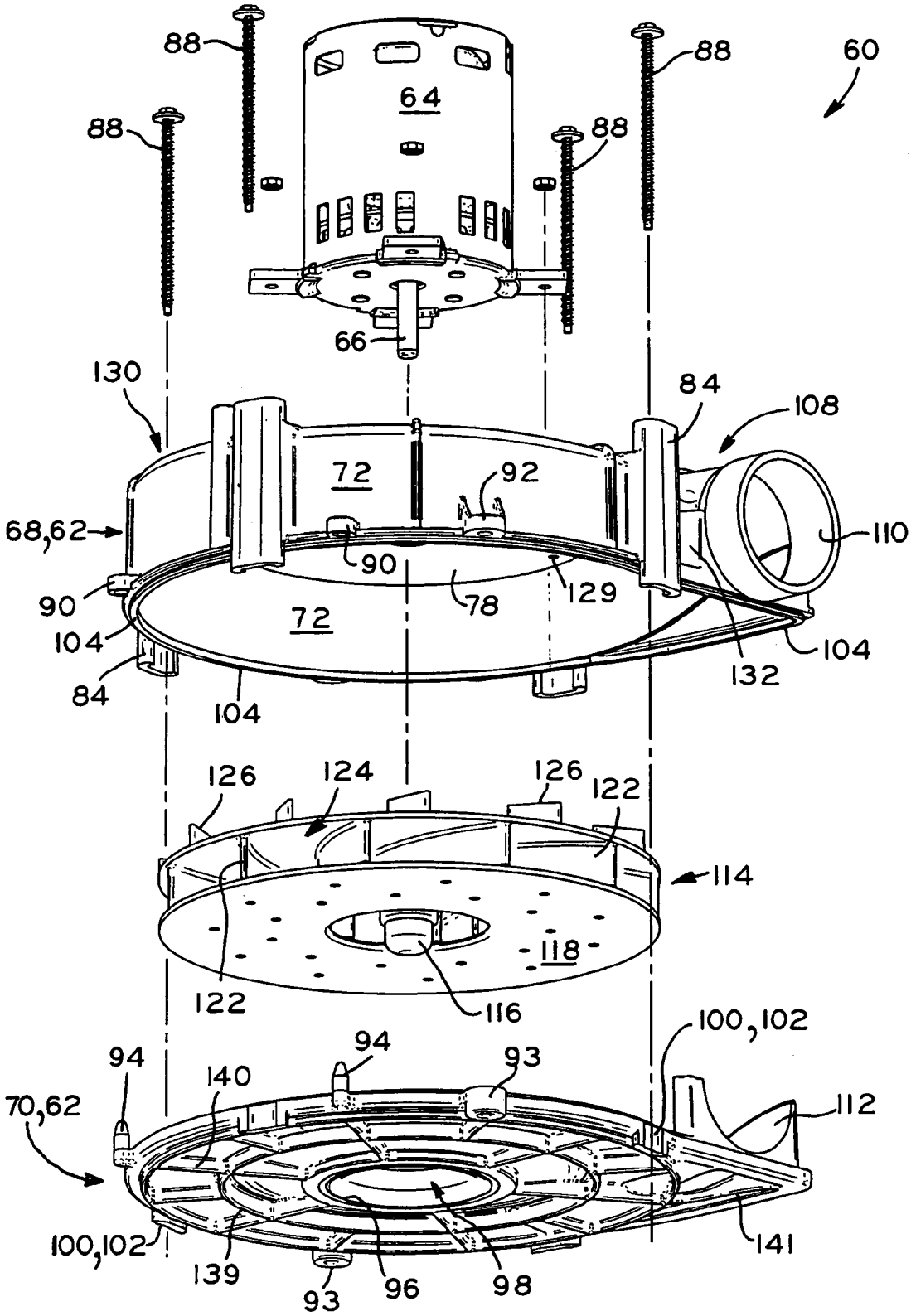
FIG. 7 is a second exploded view of the blower of FIG. 5, looking upwardly.

As may be seen in FIGS. 6 and 7, housing cover 70 cooperates with housing body to define an enclosed, circular main cavity therebetween. Referring to FIGS. 6-12, housing cover 70 includes a centrally disposed inwardly-projecting circular lip 96 defining a circular inlet opening 98. Housing cover 70 also includes a plurality of lug feet 100 having recesses 102 which align with the openings 86 of mounting lugs 84. As shown in FIG. 9, lug feet 100 of housing cover 70 and mounting lugs 84 of housing body 68 cooperate to support blower housing 62 on wall 36 of the furnace with a slight air gap provided between housing cover and furnace wall 36. As shown in FIG. 9, a gasket 52 may be provided between housing cover 70 and furnace wall 36 to provide an air seal therebetween. Further details of housing cover 70 are described below.

Referring to FIGS. 6-9, housing body 68 includes a downwardly-projecting tongue 104 disposed about the periphery thereof, which is received within a corresponding groove 106 about the periphery of housing cover 70 in a snap-fit manner to thereby secure housing cover 70 to housing body 68. Further details regarding the snap-fit attachment of housing cover 70 to housing body 68 are described in detail in U.S. Pat. No. 5,954,476 to Stewart et al., assigned to the assignee of the present invention, the disclosure of which is expressly incorporated therein by reference. Alternatively, housing body 68 may include groove 106, and housing cover 70 may include tongue 104. Optionally, a gasket or other seal (not shown) formed of a suitable resilient material, such as rubber or EPDM foam cording, for example, may be fitted between tongue 104 and groove 106 to enhance the seal therebetween. As shown in FIG. 9, lug feet 100 of housing cover 70 contact wall 36 of the furnace to maintain axial pressure on the snap-fit joint line between tongue 104 of housing body 68 and groove 106 of housing cover 70.

As shown in FIGS. 5-7, housing body 68 includes an integral exhaust transition 108 extending tangentially therefrom, which terminates in a circular exhaust outlet 110 to which an exhaust pipe or other duct structure (not shown) may be attached in a suitable manner, such as with clamps or other fasteners. Referring to FIGS. 6, 7, 11, and 12, housing cover 70 includes a contoured lobe 112 which fits with a secondary, curved joint line between housing body 68 and housing cover 70 along exhaust transition 108 in the manner described in detail in co-pending U.S. patent application Ser. No. 10/934,070, entitled LOBED JOINT DRAFT INDUCER BLOWER, filed on Sep. 3, 2004, assigned to the assignee of the present invention, the disclosure of which is expressly incorporated herein by reference.

Figure 8:
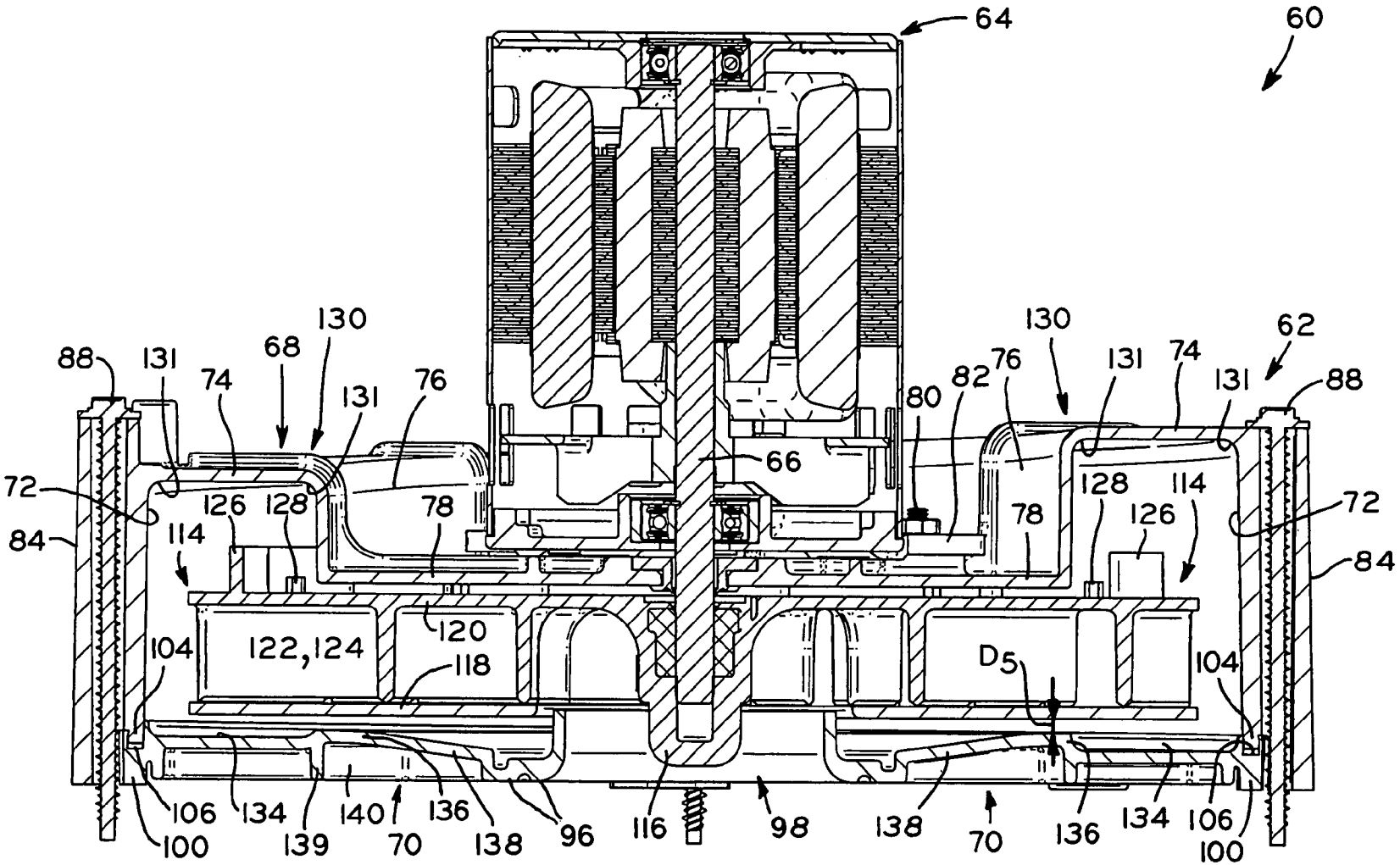
FIG. 8 is a first vertical sectional view through the blower of FIG. 5, taken along line 8-8 of FIG. 5.

Referring to FIGS. 6-9 and in particular to FIG. 8, impeller 114 includes central hub 116 which is secured to output shaft 66 of motor 64 in a suitable manner for rotation within blower housing, and also includes lower plate 118 and upper plate 120 having a plurality of backward-curved blades 122 extending from central hub 116 between lower plate 118 and upper plate 120. A plurality of blade passages 124 are defined between each pair of blades 122 radially around impeller 114. Impeller 114 also includes a plurality of auxiliary blades 126 projecting upwardly from upper plate 120, and a plurality of balancing lugs 128 projecting from upper plate 120 and spaced radially about upper plate 120. Impeller 114 may be made of a lightweight metal, or from a lightweight yet durable plastic material, for example.

Housing body 68 of blower housing 62 defines a radial X- and Y- axis dimensions which correspond to the diameter of sidewall 72 of housing body 68, as well as an axial or Z-axis dimension which is co-axial with impeller 114 and drive shaft 66 of motor 64, and which corresponds to the height of outer wall 72 of housing cover 70. As discussed in detail below, outer wall 72, top wall 74, and inner wall 76 of housing body 68 cooperate to define a volute 130 of housing body 68 which extends around the circumference and outer periphery of blower housing 62 and increases in cross-sectional area from cutoff 132 (FIGS. 13 and 14) of blower housing 62 to exhaust transition 108 of housing body 68. Cutoff 132 of blower housing 62 is a ridge-like feature within blower housing 62 which separates exhaust transition from the remainder of the interior of blower housing 62 in the radial direction of air flow within blower housing 62. Further details and advantages provided by cutoff 132 are described in detail in the above-incorporated U.S. patent application Ser. No. 10/934,070. Volute 130 is curved around the outer periphery of blower housing 62 through an angle of at least 180° and, as shown in FIGS. 5-7 and 14, volute 130 curves around the outer periphery of blower housing 62 from cutoff 132 to transition section through an angle greater than 270°.

Figure 14:
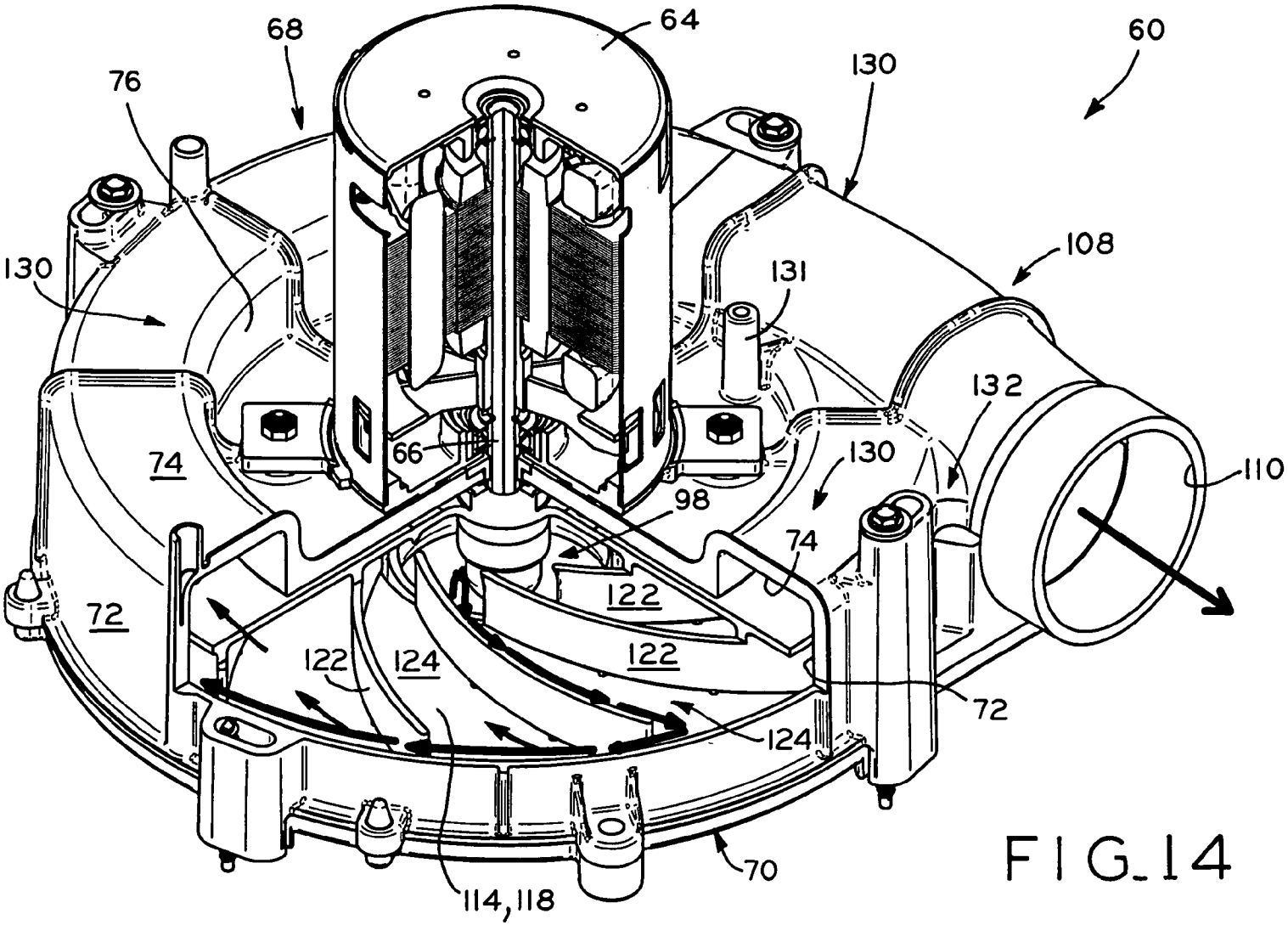
FIG. 14 is a perspective cutaway view of the blower housing of FIG. 5, with a portion of the air flow through the blower housing shown by arrows.

Referring to FIGS. 5 and 14, top wall 74 of housing body 68 slopes upwardly away from housing cover 70 in the axial or Z-axis direction as top wall 74 extends around the periphery of blower housing 62 from cutoff 132 to exhaust transition 108 of housing body 68, and correspondingly, the height of outer wall 72 and inner wall 76 increases in the axial or Z-axis direction around the periphery of blower housing 62 from cutoff 132 to exhaust transition 108 of housing body 68. In this manner, the cross-sectional area, as well as the interior volume, of volute 130 of blower housing 62 substantially consistently increases therearound from cutoff 132 to exhaust transition 108 of housing body 68.

Figure 12:
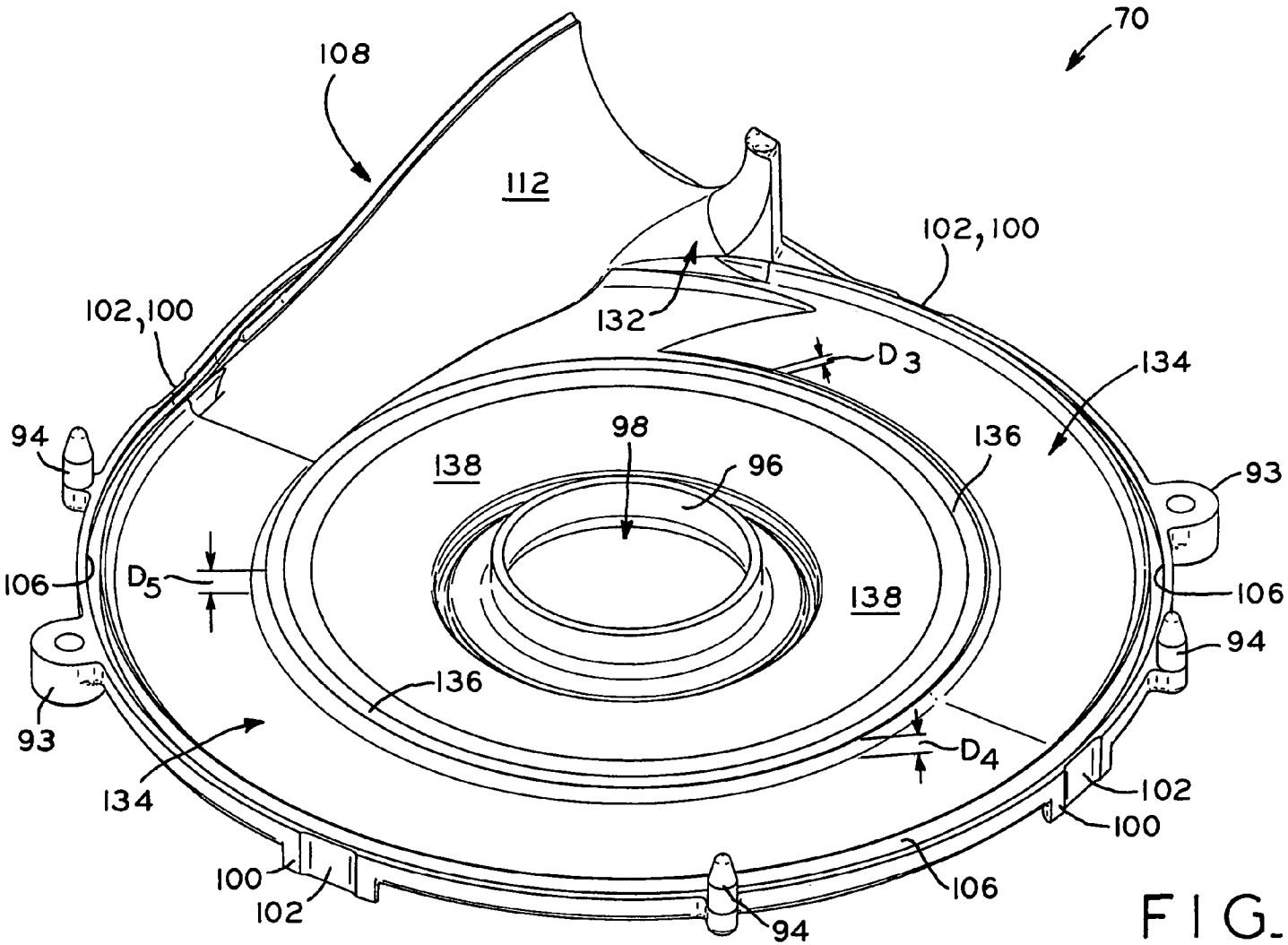
FIG. 12 is a top perspective view of the housing cover.

Referring to FIGS. 8, 9, and 12, it may also be seen that the increasing cross-sectional area and interior volume of volute 130 of blower housing 62 is also provided by housing cover 70, which includes an annular indentation or depression 134 therein having a depth which increases away from housing body 68 in the Z-axis direction radially around housing cover 70 from cutoff 132 of blower housing 62 to exhaust transition 108 of blower housing 62. Specifically, referring to FIG. 12, a first depth $D_3$ of annular depression 134 proximate cutoff 132 is less than a second depth $D_4$ of annular depression 134 at a location circumferentially spaced from cutoff 132 and disposed approximately halfway between cutoff 132 and exhaust transition 108, which in turn is less than the depth $D_5$ of annular depression 134 at a location proximate exhaust transition section 108 of housing cover 70.

Thus, as described above, the increasing cross-sectional area and volume of volute 130 is provided by the cooperation of the increasing cross-sectional area of the portion of volute 130 within housing body 68, as defined by outer wall 72, top wall 74, and inner wall 76, together with the increasing cross-sectional area provided by housing cover 70, as defined by annular depression 134 in housing cover 70. However, in an alternative construction volute 130 of blower housing 62 may have an increasing cross-sectional area from cutoff 132 to exhaust transition 108 which is provided only by the component of volute 130 which is defined by housing body 68, wherein housing cover 70 would be substantially flat. In a further alternative construction, volute 130 may have an increasing cross-sectional area from cutoff 132 to exhaust transition 108 which is provided only by annular depression 134 in housing cover 70, wherein the cross-sectional area of volute 130 within housing body would remain substantially constant therearound.

Figure 13:
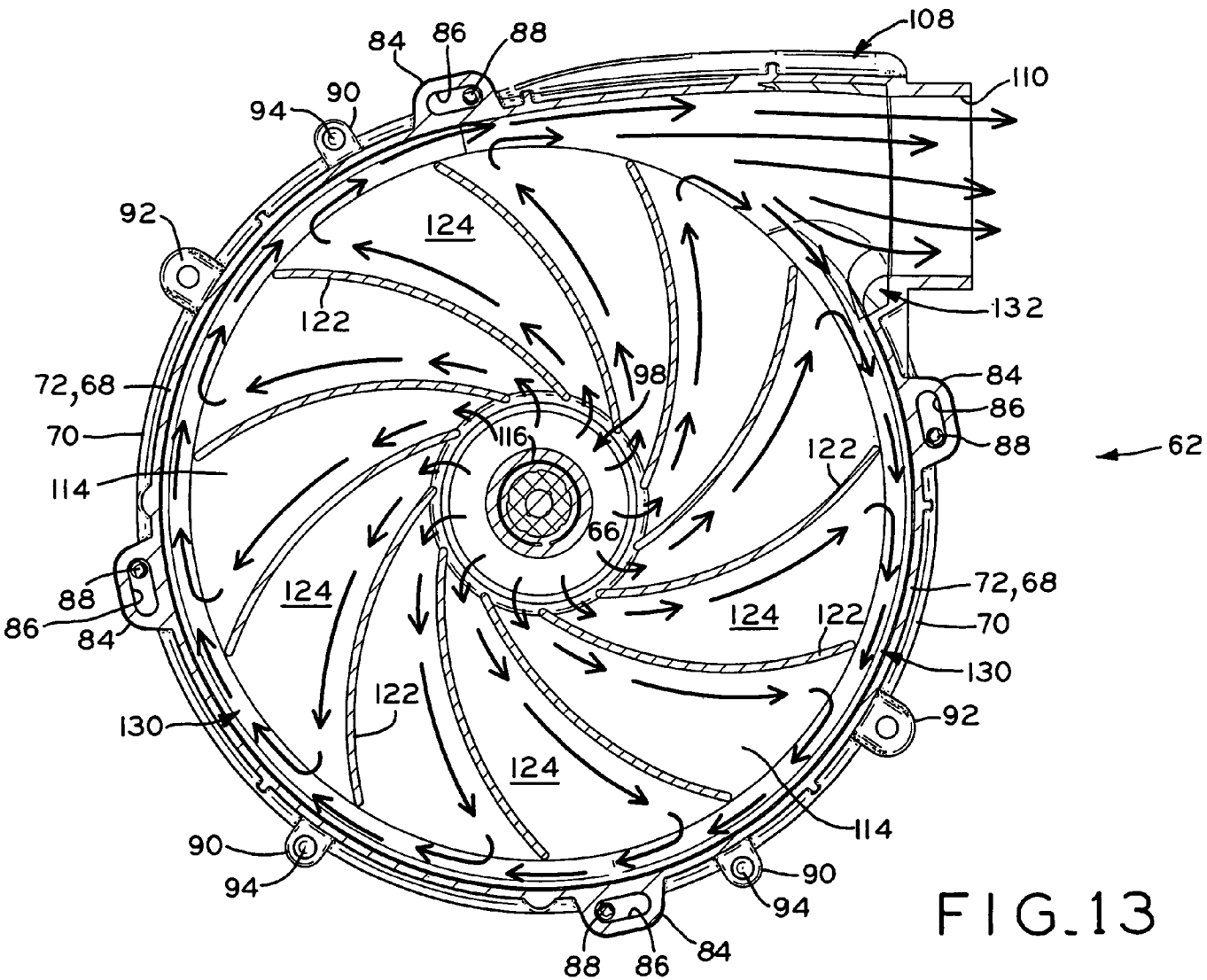
FIG. 13 is a horizontal sectional view through the blower of FIG. 5, taken along line 13-13 of FIG. 5 and looking downwardly, with the air flow through the blower housing shown by arrows.

In operation, as shown in FIGS. 13 and 14, motor 64 is actuated to rotate impeller 114 in a clockwise direction within blower housing 62 to draw air from within the interior of the furnace through inlet opening 98 of housing cover 70 and thence into the central portion of impeller 114 around central hub 116 between lower and upper plates 118 and 120 of impeller 114. Thereafter, the air is forced radially outwardly of impeller 114 between the several blade passages 124 of impeller defined between the individual blades 122 of impeller 114. The increasing cross-sectional area of volute 130 around blower housing 62 from cutoff 132 to exhaust transition 108 provides a diffuser section within blower housing 62, the cross-sectional area of which increases at substantially the same rate as the air flow which is forced radially outwardly of impeller through blade passages 124 thereof. In this manner, as impeller 114 rotates, the air flow through all of the impeller blade passages 124 is substantially uniform and the air flow around volute 130 from cutoff 132 to exhaust transition 108 has a substantially uniform average velocity. After exiting blade passages 124 of impeller 114, the air flows radially around blower housing 62 through volute to exhaust transition 108 and through outlet 110 of blower housing 62.

Thus, in blower housing 62, effective diffusion of the air flow by volute 130 is facilitated, as opposed to the known blower housing 62 of FIGS. 1-4, which lacks a volute 130 having a increasing cross-sectional area therearound which may act as a diffuser. The volute 130 of blower housing 62 according to the present invention facilitates the efficient, uniform air flow through all of the blade packages 124 of impeller 114, and eliminates the blade passage cyclical pumping effect caused by the lack of a diffuser section in the known blower housing 20 of FIGS. 1-4. Notably, because the cross-sectional area of volute 130 increases in the Z-axis direction, volute 130 may have a consistently increasing cross-sectional area from cutoff 132 to exhaust transition around blower housing 62 while allowing the use of a large diameter impeller 114 and maintaining the diameter of outer wall 72 of blower housing 62 which conforms to the standard diameter of holes 42 in wall 36 of the furnace. Typically, the diameter of the circular arrangement of holes 42 in wall 36 of the furnace is approximately 9.25 inches. Further, the increase in cross-sectional area of volute 130 in the Z-axis direction which is provided by the cooperating Z-axis directional increases of both the housing body 68 and the housing cover 70, as described above, provides a substantially constantly increasing cross-sectional area for volute 130 in the Z-axis direction while minimizing the net Z-axis movement of the air flow through volute 130, which in turn minimizes frictional losses generated by turning and spiraling of the air flow through volute 130. Due to the increased air flow efficiency provided by blower housing 62, a less powerful motor 64 is needed to generate the same air flow pressure in blower housing 62 as in the known blower housing 20 of FIGS. 1-4.

As shown in FIGS. 6-8, auxiliary blades 126 projecting from upper plate 120 of impeller 114 are disposed within the upper portion of volute 130 which is defined within housing body 68 and, due to the increasing Z-axis height of volute 130 from cutoff 132 to exhaust transition 108, auxiliary blades 126 of impeller 114 are disposed proximate top wall 74 of housing body 68 near cutoff 132, and are spaced increasingly further away from top wall 74 of housing body 68 around volute 130 toward exhaust transition 108. As impeller 114 rotates, the proximity of auxiliary blades 126 of impeller 114 to top wall 74 of housing body 68 near cutoff 132 and inner wall 76 results in effective movement of air from the gap between the inner wall 76 of housing body 68 and the upper plate 120 of impeller 114, resulting in low (or negative) air pressure in this gap. Specifically, as impeller 114 rotates, the proximity of auxiliary blades 126 of impeller 114 to the gap between inner wall 76 and the upper plate 120 of impeller 114 that is in the area between motor shaft 66 and adjacent transition area 108 and cutoff area 132 has the very low (or negative) air pressure. This region of low pressure within the gap between inner wall 76 and upper plate 120 may conveniently be used for the installation of a static pressure tap hole, commonly called a static tap 129, shown in FIG. 7, within a static tap boss 131 (FIGS. 5, 6 and 14) provided in blower housing 62 when blower housing 62 is used with high efficiently furnaces which include a pressure switch (not shown) requiring a static tap on the draft inducer. Generally, pressure switches are operable to detect the generation of low pressure within a blower housing upon rotation of impeller within the blower housing in order to provide an indication to the control unit of the furnace that the blower is generating an adequate air flow through the furnace and exhaust ducting before the furnace begins gas combustion for heating. Alternatively, impeller 114 may lack auxiliary blades 124 projecting from upper plate 120, with top wall 74 of housing body 68 disposed closely proximate upper plate 120 of impeller 114 near cutoff 132.

Referring to FIGS. 6-8, outer wall 72 of housing cover 68 is cylindrically-shaped, and is preferably straight and smooth in the Z-axis direction to facilitate the smooth flow of air over outer wall 72 through volute 130. In this manner, the air flow through volute 130 is circumferentially laminar with respect to outer wall 72, wherein outer wall 72 guides the air flow tangentially from volute 130 into exhaust transition 108 and reduces the amount of the air flow which might impinge upon cutoff 132, which could decrease the efficiency of the air flow through blower housing 62. Also, as may be seen in FIG. 8, the corners 131 of volute 130 defined between outer wall 72 and top wall 74, and between top wall 74 and inner wall 76, are minimally radiused, which maximizes the interior volume of volute 130.

In an alternative construction, inner wall 76 may have a scroll shape in which the shape of outer wall 72 remains substantially cylindrical, and inner wall 76 spirals radially inwardly toward the central axis of blower housing 62, defined by output shaft 66 of motor and the rotational axis of impeller 114. In this manner, the distance between outer wall 72 and inner wall 76 would increase around volute 130 from cutoff 132 toward exhaust transition 108 of blower housing 62. Thus, the width of volute 130 would increase in the radial direction therearound from cutoff 132 toward exhaust transition 108 to provide a constantly increasing cross-sectional area for volute 130 from cutoff 132 toward exhaust transition 108 while maintaining the same diameter and arrangement of mounting lugs 84. The radial width of volute 130 could increase around blower housing 62 from cutoff 132 toward exhaust transition 108 along with the Z-axis height of volute 130 as described above. However, such an inwardly-scrolled profile for inner wall 76 may be limited by the size of motor 64, as well as the attachment features of motor 64, such as mounting flanges 82, which are used to attach motor 64 to recessed wall 78 of blower housing 62.

Although the inclination or slope of top wall 74 of housing cover 68 from cutoff 132 to exhaust transition 108 may vary to in turn vary the increase in Z-axis height of volute 130 of blower housing 62, it is preferable that the maximum Z-axis height of blower housing 62 not exceed the Z-axis height of the known blower housing 20 shown in FIGS. 1-4 to allow backward compatibility of blower housing 62 with known furnaces. Advantageously, the decrease in the overall Z-axis height of volute 130 of blower housing 62 from cutoff 132, which is provided by the slope of top wall 74 in the blower housing 62 of the present invention, allows greater manufacturing flexibility in the placement of peripheral components such as capacitors, pressure switches, static tap tubes, etc., onto and around blower housing 62 as compared with the known blower housing 20 of FIGS. 1-4.

Optionally, the outer rims of lower and upper plates 118 and 120 of impeller 114 may be rounded in the interior sides thereof to facilitate the turn of the air flow from a radially outward direction from blade passages 124 to a circumferential direction within volute 130. Additionally, it is contemplated that rather than using a generally planar impeller, as shown in FIG. 8 and described above, a conical or dish-shaped impeller may be used, including blades which are curved upwardly to occupy a larger portion of the area of volute 130. Such blades would not only force air radially outwardly of the impeller into volute 130, but would also force air upwardly in the Z-axis direction from the impeller into the portion of volute 130 which is defined within housing body 68. In this manner, such a conical or dish-shaped impeller may aid in directing air upwardly in the Z-axis direction into the constantly expanding area of volute 130 defined in housing body 68 of blower housing 62 toward exhaust transition 108 to reduce spiraling within the air flow as the air flow proceeds to exhaust transition 108 through the expanding volume of volute 130.

Referring to FIGS. 8 and 12, housing cover 70 includes an annular ridge 136 located radially inwardly of annular depression 134, and a substantially conically-shaped annular wall 138 sloping downwardly in the Z-axis direction away from housing body 68 from annular ridge 136 toward lip 96 of inlet opening 98 of housing cover 70. As may be seen from FIGS. 8, and 12, ridge 136 is disposed closely proximate lower plate 118 of impeller 114. Specifically, ridge 136 is spaced from lower plate 118 of impeller 114 by a minimal distance $D_5$, which is typically about 0.118 inches. The minimized distance between ridge 136 and lower plate 118 of impeller 114 reduces or prevents backflow of air from within volute 130 radially inwardly between lower plate 118 of impeller 114 and housing cover 70 toward inlet opening 98, and therefore aids in effectively sealing the air flow within volute 130 from the flow intake of air through inlet opening 98 and into the central portion of impeller 114 about central hub 116 thereof between lower and upper plates 118 and 120 in order to increase the efficiency of the air flow within blower housing 62.

Figure 10:
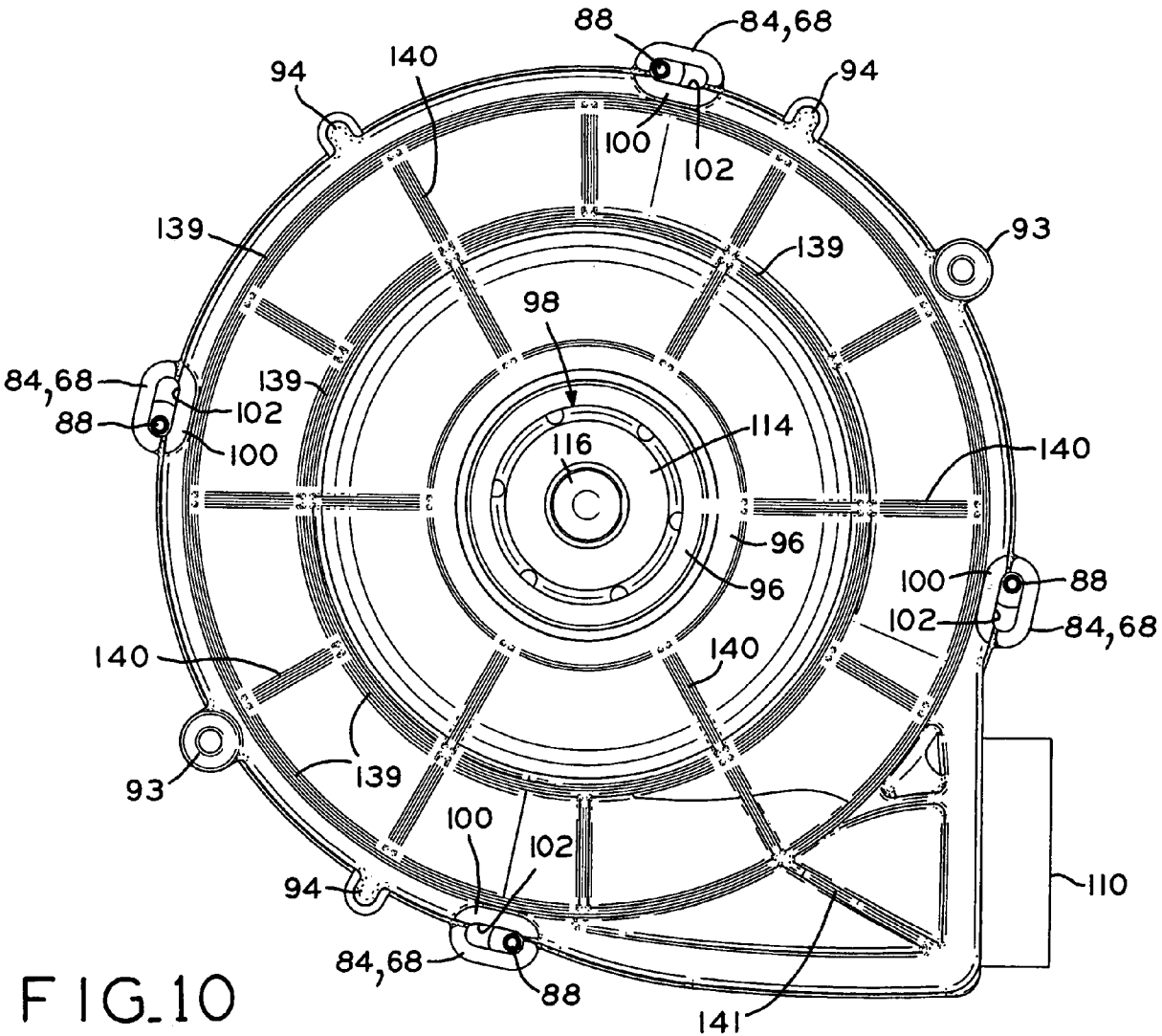
FIG. 10 is a bottom view of the blower housing.
Figure 11:
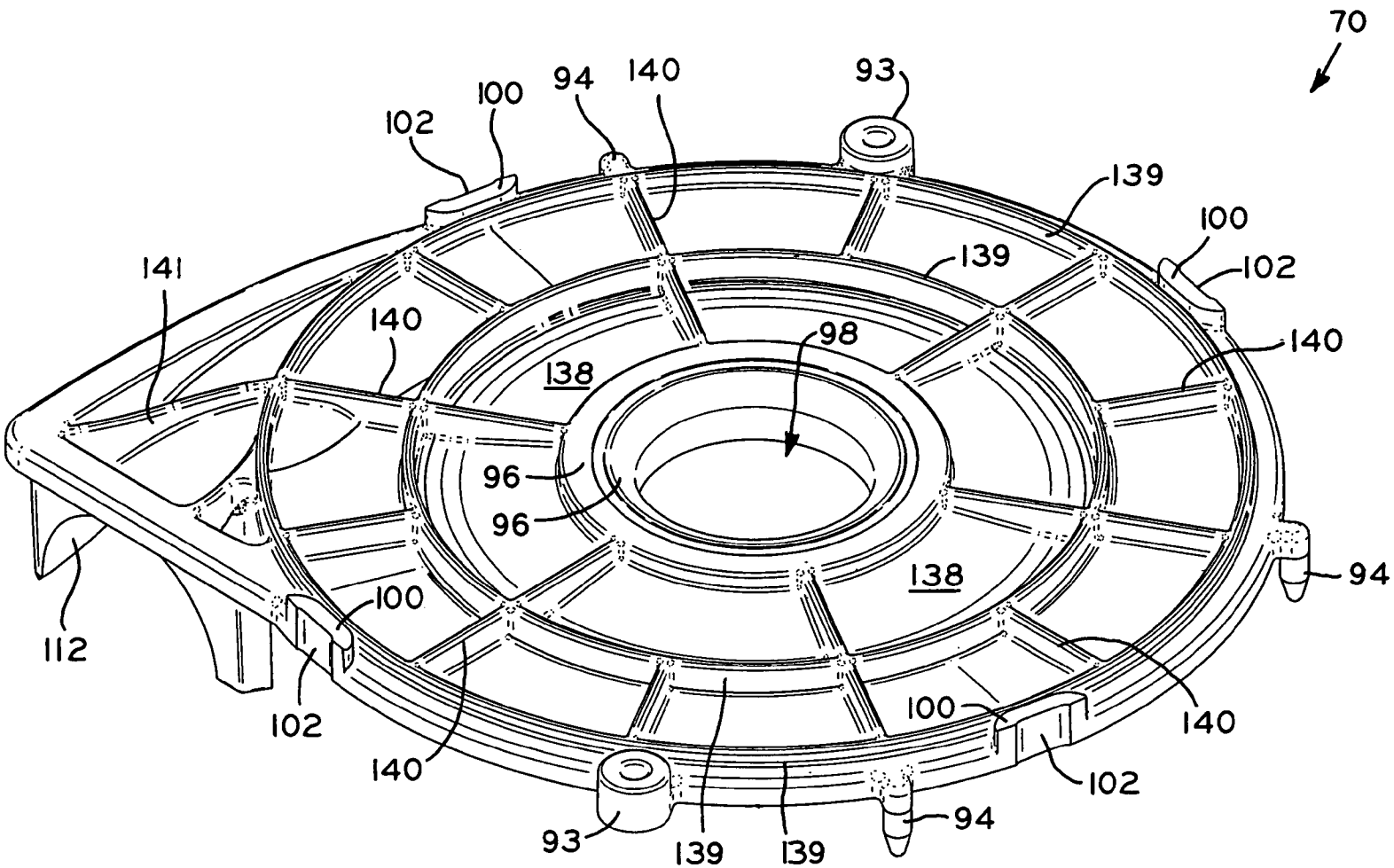
FIG. 11 is a bottom perspective view of the housing cover.

Additionally, as shown in FIGS. 10 and 11 housing cover 70 includes concentric annular stabilizing ribs 139, and a plurality of radial stabilizing ribs 140 extending between lip 96 of inlet opening 98 of housing cover 70 to the outer periphery of housing cover. An additional stabilizing rib 141 extends outwardly of the outermost annular rib 139 along the exhaust transition portion of housing cover 70. Ribs 139, 140, and 141 rigidify housing cover 70 and prevent inward deflecting of housing cover 70 towards impeller 114 when blower housing 62 is mounted to wall 36 of a furnace. Specifically, as shown in the right side of FIG. 9, even with a gasket 52 captured between housing cover 70 and furnace wall 36, stabilizing ribs 140 of housing cover 70 minimize inward deflection of lip 96 of housing cover 70 toward lower plate 118 of impeller 114, such that a distance of approximately 0.116 inches remains therebetween at location $D_5$, and choking of the air flow through inlet opening 98 of housing cover 70 into impeller 114 is reduced or eliminated. Notably, even if some inward deflecting of housing cover 70 occurs upon installation of blower housing 62 to a furnace, the conically-shaped annular wall 138 of housing cover 70 provides a clearance area 142 between housing cover 70 and lower plate 118 of impeller 114 to accommodate some inward deflection of lip 96 of housing cover 70.

Finally, although blower housing 62 is shown in FIGS. 5-14 configured in a "clockwise" orientation, in which the shape of blower housing 62 is configured for clockwise rotation of impeller 114, blower housing 62 may alternatively be configured in a "counterclockwise" orientation, in which the shape of blower housing 62 is configured for counterclockwise rotation of impeller 114.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A blower housing defining perpendicular axial and radial directions, comprising;

a first housing member;

a second housing member attached to said first housing member to define a cavity therebetween, said second housing member further comprising:

an inlet opening;

an annular ridge around said inlet opening and disposed radially outwardly of said inlet opening, said annular ridge projecting into said cavity toward said second housing member; and a substantially conically-shaped annular wall extending from said ridge radially inwardly to said inlet opening, said wall sloped from said ridge to said inlet opening in a direction axially away from said first housing member.

2. The blower housing of claim 1, wherein said second housing member further comprises a plurality of stiffening ribs extending in directions radially away from said inlet opening.

3. The blower housing of claim 1, wherein said second housing member further comprises a lip about said inlet opening, said lip projecting radially inwardly toward said first housing member.

4. A blower housing having an outer periphery and defining perpendicular radial and axial directions, said blower housing comprising:

a housing body and a housing cover defining a cavity therebetween, said housing cover having a bottom wall;

a plurality of mounting lugs disposed in spaced relation around the outer periphery of said housing body;

an inlet and an outlet, each defined within at least one of said housing body and said housing cover;

a cutoff within said blower housing, said cutoff disposed proximate said outlet; and a volute having a first portion with a substantially greater area defined within said housing body and a second portion with a substantially lesser area formed as an annular depression in said bottom wall of said housing cover which slopes in the axial direction, said volute curved around said outer periphery of said blower housing through an angle of at least 180° and having a combined cross-sectional area which substantially continuously increases toward said outlet.

5. A blower housing having an outer periphery and defining perpendicular radial and axial directions, said blower housing comprising:

first and second housing members defining a cavity therebetween;

a plurality of mounting lugs disposed in spaced relation around the outer periphery of said blower housing;

an inlet and an outlet, each defined within at least one of said first and second housing members;

a cutoff within said blower housing, said cutoff disposed proximate said outlet; and a volute defined within at least one of said first and second housing members, said volute curved around said outer periphery of said blower housing through an angle of at least 180° and having a cross-sectional area which substantially continuously increases toward said outlet, wherein said volute has a top wall and a bottom wall, and wherein said top wall substantially continuously slopes in the axial direction away from said bottom wall around said blower housing from said cutoff to a transition section disposed proximate said outlet, and from said transition section, then slopes in the axial direction toward said bottom wall to transition to a circular cross-sectional shape at said outlet.

6. A blower housing defining perpendicular radial and axial directions, said blower housing comprising:

a housing body and a housing cover defining a cavity therebetween;

a plurality of mounting lugs including apertures, said mounting lugs disposed in spaced relation around said housing cover;

an inlet defined within a bottom wall of said housing cover;

a circular outlet defined within at least one of said housing body and said housing cover, said outlet facing in the radial direction;

a cutoff within said blower housing proximate said outlet;

a transition section defined in at least one of said housing body and said housing cover proximate said outlet; and a volute defined within at least one of said housing body and said housing cover, said volute curved through an angle of at least 180° and having a substantially rectangular cross-sectional shape, said volute having a top wall which substantially continuously slopes in the axial direction away from said bottom wall around said blower housing from said cutoff to said transition section, and from said transition section, then slopes in the axial direction toward said bottom wall to transition to a circular cross-sectional shape at said outlet.

7. A blower housing having an outer periphery and defining perpendicular radial and axial directions, said blower housing comprising:

first and second housing members defining a cavity therebetween;

a plurality of mounting lugs disposed in spaced relation around the outer periphery of said blower housing;

an inlet and an outlet, each defined within at least one of said first and second housing members, said inlet comprises a centrally disposed opening in said second housing member, said inlet facing substantially in the axial direction; and said outlet comprises a circular opening defined by at least one of said first and second housing members, said outlet facing substantially in the radial direction;

a cutoff within said blower housing, said cutoff disposed proximate said outlet; and a volute defined within at least one of said first and second housing members, said volute curved around said outer periphery of said blower housing through an angle of at least 180° and having a cross-sectional area which substantially continuously increases toward said outlet, wherein said second housing member further comprises:

an annular ridge disposed within said cavity; and an annular wall sloping in the axial direction radially inwardly from said annular ridge toward said inlet opening.

8. A blower assembly, comprising:

a blower housing having a substantially circular outer periphery defining perpendicular axial and radial directions, said blower housing comprising:

a first housing member attached to a second housing member, said first and second housing members together defining a cavity therebetween;

a plurality of mounting lugs formed as a portion of at least one of said first and second housing members, said mounting lugs disposed in spaced relation around said outer periphery;

an inlet opening in said second housing member, said inlet comprising a centrally disposed opening in said second housing member, said inlet facing substantially in said axial direction;

a outlet opening defined by at least one of said first and second housing members, said outlet comprising a circular opening in at least one of said first and second housing members, said outlet facing substantially in said radial direction;

a cutoff disposed proximate said outlet; and a volute formed as a portion of at least one of said first and second housing members, said volute curved around said outer periphery through an angle of at least 180° from a first end thereof proximate said cutoff to a second end thereof proximate said outlet, said volute section having a cross-sectional area which substantially continuously increases from said first end toward said second end;

a motor mounted to one of said first and second housing members, said motor having a rotatable shaft extending into said cavity; and an impeller coupled to said shaft for rotation therewith, said impeller disposed within said cavity, wherein said second housing member further comprises:

an annular ridge disposed within said cavity; and an annular wall sloping in the axial direction radially inwardly from said annular ridge toward said inlet opening.

9. A blower assembly, comprising:

a blower housing having a substantially circular outer periphery defining perpendicular axial and radial directions, said blower housing comprising:

a first housing member attached to a second housing member, said first and second housing members together defining a cavity therebetween;

a plurality of mounting lugs formed as a portion of at least one of said first and second housing members, said mounting lugs disposed in spaced relation around said outer periphery;

an inlet opening in said second housing member;

a outlet opening defined by at least one of said first and second housing members;

a cutoff disposed proximate said outlet; and a volute formed as a portion of at least one of said first and second housing members, said volute curved around said outer periphery through an angle of at least 180° from a first end thereof proximate said cutoff to a second end thereof proximate said outlet, said volute section having a cross-sectional area which substantially continuously increases from said first end toward said second end, wherein said volute has a top wall and a bottom wall, and wherein said top wall substantially continuously slopes in the axial direction away from said bottom wall around said blower housing from said cutoff to a transition section disposed proximate said outlet, and from said transition section, then slopes in the axial direction toward said bottom wall to transition to a circular cross-sectional shape at said outlet;

a motor mounted to one of said first and second housing members, said motor having a rotatable shaft extending into said cavity; and an impeller coupled to said shaft for rotation therewith, said impeller disposed within said cavity.

10. A blower housing defining perpendicular radial and axial directions, said blower housing comprising:

first and second housing members defining a cavity therebetween;

a plurality of mounting lugs including apertures, said mounting lugs disposed in spaced relation around said blower housing;

an inlet defined within a bottom wall of at least one of said first and second housing members;

a circular outlet defined within at least one of said first and second housing members, said outlet facing in the radial direction;

a cutoff within said blower housing proximate said outlet;

a transition section defined in at least one of said first and second housing members proximate said outlet; and a volute defined within at least one of said first and second housing members, said volute curved through an angle of at least 180° and having a substantially rectangular cross-sectional shape, said volute having a top wall which substantially continuously slopes in the axial direction away from said bottom wall around said blower housing from said cutoff to said transition section, and from said transition section, then slopes in the axial direction toward said bottom wall to transition to a circular cross-sectional shape at said outlet.

11. The blower housing of claim 10, wherein said volute has a width defined in the radial direction, said width being substantially constant around said volute.

12. The blower housing of claim 10, wherein said mounting lugs are integrally formed with one of said first and second housing members.

13. The blower housing of claim 10, wherein said second housing member includes said inlet, and further comprises:

an annular ridge disposed within said cavity; and an annular wall sloping in the axial direction radially inwardly from said annular ridge toward said inlet.

14. The blower housing of claim 13, wherein said second housing member further includes a plurality of reinforcement ribs extending from said inlet toward an outer periphery of said blower housing.

15. The blower housing of claim 10, wherein at a location of said volute proximate said cutoff, said top wall of said volute is disposed closer to said bottom wall than an upper end of said circular outlet.

16. The blower housing of claim 10, wherein at a location of said volute proximate said cutoff, said top wall of said volute is disposed closer to said bottom wall than an upper end of said circular outlet.

* * * * *